United States Patent [19]

Lindner et al.

[11] 4,417,949

[45] Nov. 29, 1983

[54] ENHANCED ALUMINUM ETCHANT

[75] Inventors: Walter E. Lindner; Elias Malakelis, both of St. Louis County, Mo.

[73] Assignee: McDonnell Douglas Corporation, St. Louis, Mo.

[21] Appl. No.: 415,146

[22] Filed: Sep. 7, 1982

[51] Int. Cl.[3] ..... C23F 1/00; C23F 1/02

[52] U.S. Cl. ..... 156/665; 156/659.1; 252/79.5

[58] Field of Search ..... 156/642, 654, 656, 659.1, 156/665; 252/79.5, 156; 204/129.1, 129.65

[56] References Cited

FOREIGN PATENT DOCUMENTS 48-28541 3/1973 Japan ..... 252/79.5

1383383 2/1975 United Kingdom ..... 252/79.5

OTHER PUBLICATIONS

Transactions of the Institute of Metal Finishing, vol. 48, 1970, Chemical Etching of Aluminum in Caustic Soda Based Solution by J. M. Kape, pp. 43–50.

*Primary Examiner*—William A. Powell

*Attorney, Agent, or Firm*—Gravely, Lieder & Woodruff

[57] ABSTRACT

This disclosure concerns a process for increasing the etch rate of an aluminum and aluminum alloy chem-milling composition while increasing the tank life of the composition by adding sodium nitrate to a composition containing sodium hydroxide as the principal active ingredient.

3 Claims, No Drawings

ENHANCED ALUMINUM ETCHANT

BACKGROUND OF THE INVENTION

The present invention relates to chemical milling of metals and is particularly related to an enhanced chem-milling composition for treating aluminum and aluminum alloys.

Conventionally chem-milling of aluminum in the aircraft industry involves reacting the part to be milled with a solution which contains sodium hydroxide (NaOH) as the basis of the etchant. There is one major problem with chem-milling compositions of this type, namely, that the metal removal rate is limited to about 3 mil/min/surface. Another difficulty with a chem-milling solution which has sodium hydroxide as its basis is that the solution does not produce an acceptable part when the dissolved metal reaches about 60 g/liter of solution. This is caused by interference of the reaction by-products with the chem-milling reaction.

The typical aluminum etchant reaction is:

$$2Al + 2NaOH + 2H_2O \rightarrow 2NaAlO_2 + 3H_2 \uparrow$$

The amount of $NaAlO_2$ in the etching solution is what eventually causes the chem-milling solution in the tank to become deficient in regards to the finish imparted to the surface of the part being milled. The amount of NaOH is limited by the need for $H_2O$ in the tank to complete the foregoing reaction scheme. Hence, at most the tank can be 15–30% NaOH. This limits the etch rate to about 3 mil/min/surface.

Accordingly, it is an object of the present invention to increase the etch rate of the aluminum by adding sodium nitrate ($NaNO_3$) to the etchant.

We also have found that the addition of sodium nitrate extends the life of the etchant, resulting in lower chemical costs, lower tank make up costs and lower tank disposal costs.

Thus, it is another principal object of this invention to provide an aluminum etch solution which, not only provides faster etch rates, but also conserves chemical usage by increasing the life of the etchant and decreasing the amount of waste to be disposed. This is important for environmental reasons as chemical dumps are less accessible than before and the cost of disposal is greater.

The faster etch rates result in increased production without any capital expenditures and accordingly decreased processing costs.

These and other objects and advantages will become apparent hereinafter.

SUMMARY OF THE INVENTION

The present invention comprises a composition and process for etching aluminum containing sodium hydroxide, water, and sodium nitrate, which results in faster etch rates and longer tank life for the etchant.

DETAILED DESCRIPTION

As mentioned, the typical aluminum etching reaction is:

$$2Al + 2NaOH + 2H_2O \rightarrow 2NaAlO_2 + 3H_2 \uparrow$$

The production of $NaAlO_2$ and its buildup in the etching solution in the tank is what eventually causes the tank to cease producing satisfactory surface finish on etched parts.

When sodium nitrate is added to the etchant, two phenomena occur. The first is that the etchant has the potential to react or etch at significantly greater rates, i.e., at least about 50% and preferably from 60–80% faster than the etching rate without the sodium nitrate. For example, the maximum etch rate presently is about 3 mil/min/surface, while the addition of sodium nitrate raises this rate to 5–5.5 mil/min/surface.

It is believed that the reaction of sodium nitrate in the etch solution is as follows:

$$4NaNO_3 + 10H_2O \xrightarrow[\Delta]{Al} 4NaOH + 4NH_3 \uparrow + 15O_2 \uparrow$$

Thus, the addition of sodium nitrate results in formation of additional sodium hydroxide as the original sodium hydroxide is being used up at the metal interface. This generation of sodium hydroxide has a substantial effect on metal removal rates, increasing the rate from 2.5–3 mil/min/surface to about 5–5.2 mil/min/surface.

The other effect noticed, namely the increased tank life is the result of the reduced formation of the sodium aluminate ($NaAlO_2$). This compound is formed from the reaction of sodium hydroxide with aluminum and its build up eventually poisons the etch solution. However, when sodium nitrate is added, the build up of sodium aluminate is reduced, probably because of its reaction with ammonia ($NH_3$) to produce aluminum hydroxide [$Al(OH)_3$]. Aluminum hydroxide does not interfere with the operation of the etchant.

EXAMPLE NO. 1

The following is a specific detailed disclosure of a preferred process of chemically milling aluminum and aluminum alloys, specifically 2024-T3 and 7075-T6 alloys.

Aluminum panels, 3×4×0.1 inch of 2024-T3 and 7075-T6 alloys were cleaned, coated with a proprietary maskant, scribed and the appropriate maskant removed to produce a 3×1 inch surface area for milling. The foregoing procedures all are standard in the industry and are well known to those working in the aluminum chem-milling field.

Six liters of the following standard aluminum chem-mill solution were prepared:

| Material | Concentration | Temperature |
|---|---|---|
| Sodium hydroxide, 50% Commercial | 24.2 gal/100 gal of etchant | |
| Tri-ethanol-amine, 98% Grade | 2.0 gal/100 gal of etchant | 190 F. Min. |
| TFE No. 3 Turco Products, Inc. | 3.3 gal/100 gal of etchant | 200–225 F. Preferred |
| Water | Remainder | |

A chemical milling tank was half filled with tap water. Then the other materials specified were added. The balance of water was added to bring the tank to its operating level. The solution was mixed thoroughly using compressed air. Then the air was turned off and the tank was heated to operating temperature. TFE Defoamer No. 4 (Turco Products, Inc.) may be added at 0.12 oz/100 gallons of solution as needed to prevent excessive foaming when chem-milling large skins. The solution is analyzed to determine "free" NaOH($N_1$) and dissolved metal content ($N_2$). $N_1$ and $N_2$ shall be controlled within the following ranges:

$N_1$—21–34

$N_2$—14 maximum

Following is the analytical procedure used to determine $N_1$ and $N_2$:

(1) Standardize the pH meter with 10 pH buffer solution.

(2) Rinse the electrode and place it in a 250 ml beaker containing approximately 120 ml of distilled water and a Teflon coated Magnestir stirring rod.

(3) Pipet a 5.0 ml sample of the etchant into the beaker.

(4) Titrate with 1.0N $H_2SO_4$ until a pH of 11.3 is reached. Approach the end-point slowly and allow sufficient time for the pH meter to reach equilibrium.

(5) Continue the titration with 1.0N $H_2SO_4$ until a pH of 8.2 is reached.

(6) $N_1$=Number of mls 1.0N $H_2SO_4$ to reach pH 11.3; $N_2$=Number of mls 1.0N $H_2SO_4$ to go from pH 11.3 to 8.2

Table No. 1 shows the data on solution make-up, dissolved metal content, $N_1$ and $N_2$ values, additions of ingredients, additions of $NaNO_3$ and etch rates.

The etched parts are cleaned using a standard desmutting solution containing nitric and hydrofluoric acid as active ingredients.

The etch rate in mils/min/side is calculated as follows:

$$\frac{(0.5)\ (\text{Initial thickness mil} - \text{Final thickness, mils})}{(\text{Etch time, min.})}$$

The initial composition of the etching solution is as follows:

168 to 272 g/l NaOH 20 to 35 g/l triethanolamine or equivalent used to improve surface finish of the aluminum 45 to 60 g/l TFE a product made by Turco (a division of Purex) to improve radii contour 10 to 30 g/l sodium nitrate It is necessary to maintain a concentration of free NaOH ($N_1$) in the range of 21–34 by the periodic addition of 50% NaOH. As stated previously, the etch rate and the chem-milling quality decrease as the dissolved metal concentration ($N_2$) increases. Periodic additions of $NaNO_3$, up to a maximum of about 70 g/l, increase the etch rate and maintain acceptable chem-mill quality at dissolved metal concentration as high as approximately 100 g/l which is equivalent to an $N_2$ number of about 22, much higher than the present maximum $N_2$=14. Addition of additional amounts of $NaNO_3$ are counterproductive and do not enhance etch rates or solution life.

Table No. 1 which follows shows data on etchant make-up, dissolved metal content, $N_1$ and $N_2$ values, incremental additions of $NaNO_3$ and etch rates. This table clearly shows the corresponding increase in etch rate without any incremental addition of NaOH, until 60 g/l $NaNO_3$ have been added.

TABLE NO. 1

| MAKE UP ADDITIONS | | | TOTAL | | | $NaNO_3$ | | ANALYSIS | | | |
|---|---|---|---|---|---|---|---|---|---|---|---|
| 50% | | | DISSOLVED | SOLUTION | | ADDITIONS | | AFTER $NaNO_3$ | | | ETCH |
| NaOH[1] | TEA[1] | TFE[1] | METAL | ANALYSIS | | STEP | CUM. | ADDITIONS | | | RATE |
| (ml/l) | (ml/l) | (ml/l) | (g/l) | $N_1$ | $N_2$ | (g/l) | (g/l) | $N_1$ | $N_2$ | ALLOY | (m/m/s) |
| 242 | 20 | 33 | 0 | 24.0 | 0.5 | 0 | 0 | — | — | 2024-T3 | 2.7 |
| 0 | 0 | 0 | 27.0 | 22.0 | 7.2 | 0 | 0 | — | — | — | — |
| 83 | 4 | 6 | 27.0 | 27.0 | 6.4 | 0 | 0 | — | — | — | — |
| 0 | 0 | 0 | 35.4 | 25.4 | 7.9 | 0 | 0 | — | — | — | — |
| 0 | 0 | 0 | 39.8 | 24.6 | 8.8 | 0 | 0 | — | — | — | — |
| 83 | 4 | 6 | 39.8 | — | — | 0 | 0 | — | — | 2024-T3 | 2.0 |
| 42 | 2 | 3 | 41.1 | — | — | 0 | 0 | — | — | 7075-T6 | 2.6 |
| 0 | 0 | 0 | 42.5 | 34.0 | 9.0 | 0 | 0 | — | — | 7075-T6 | 3.1 |
| 0 | 0 | 0 | 43.9 | — | — | 0 | 0 | — | — | 2024-T3 | 2.6 |
| 0 | 0 | 0 | 45.3 | — | — | 10 | 10 | — | — | 7075-T6 | 3.3 |
| 0 | 0 | 0 | 46.8 | — | — | 0 | 10 | — | — | 2024-T3 | 2.8 |
| 0 | 0 | 0 | 48.0 | — | — | 10 | 20 | 33.2 | 10.5 | 7075-T6 | 3.0 |
| 0 | 0 | 0 | 49.5 | — | — | 0 | 20 | — | — | 2024-T3 | 3.4 |
| 0 | 0 | 0 | 51.0 | — | — | 10 | 30 | — | — | 2024-T3 | 4.0 |
| 0 | 0 | 0 | 52.7 | — | — | 0 | 30 | — | — | 7075-T6 | 3.0 |
| 0 | 0 | 0 | 54.0 | — | — | 10 | 40 | 34.0 | 11.7 | 7075-T6 | 4.2 |
| 0 | 0 | 0 | 55.8 | — | — | 0 | 40 | — | — | 2024-T3 | 4.3 |
| 0 | 0 | 0 | 57.7 | — | — | 10 | 50 | — | — | 7075-T6 | 4.0 |
| 0 | 0 | 0 | 59.0 | — | — | 0 | 50 | — | — | 2024-T3 | 5.2 |
| 0 | 0 | 0 | 60.7 | — | — | 10 | 60 | 32.9 | 13.3 | 7075-T6 | 4.9 |
| 0 | 0 | 0 | 62.3 | — | — | 0 | 60 | — | — | 2024-T3 | 5.7 |
| 0 | 0 | 0 | 63.8 | 32.5 | 13.6 | 10 | 70 | 32.5 | 13.6 | — | — |
| 0 | 0 | 0 | 109.9 | 26.6 | 22.9 | 0 | 70 | — | — | — | — |
| 0 | 0 | 0 | 137.3 | — | — | 0 | 70 | — | — | 7075-T6 | 1.1 |
| 0 | 0 | 0 | 137.8 | 21.0 | — | 20 | 90 | 22.0 | — | 7075-T6 | 2.4 |
| 0 | 0 | 0 | 138.9 | — | — | 20 | 110 | 21.7 | — | 7075-T6 | 2.4 |

[1] First entry in column is the initial make-up quantity. Subsequent entries indicate addition of a component.

What is claimed is:

1. A process of chem-milling aluminum and aluminum alloys comprising the steps of adding in increments up to 70 g/l of sodium nitrate to a chem-milling composition which contains sodium hydroxide and continuing the chem-milling until the concentration of dissolved aluminum in the solution is about 120 g/l.

2. In a chem-milling composition comprising sodium hydroxide as the principal active ingredient and triethanolamine, the improvement which comprises the incremental addition of up to about 70 g/l of sodium nitrate per litter of chem-milling solution.

3. The composition of claim 2 wherein the etching rate of the chem-milling composition is increased by at least 50% and the tank life of the composition is increased by at least about 55% as compared to a similar composition not containing the sodium nitrate.

* * * * *